US007315718B2

(12) United States Patent
Sisler et al.

(10) Patent No.: US 7,315,718 B2
(45) Date of Patent: Jan. 1, 2008

(54) CAST-COATED PAPERS HAVING ENHANCED IMAGE PERMANENCE WHEN USED WITH COLOR XEROGRAPHIC PRINTING AND A METHOD OF PRINTING THE CAST-COATED PAPERS IN AN ELECTROPHOTOGRAPHIC APPARATUS

(75) Inventors: Gordon Sisler, St. Catharines (CA); Guiqin Song, Toronto (CA); Jingsong Tang, New Orleans, LA (US); T. Brian McAneney, Burlington (CA)

(73) Assignee: Xerox Corporation, Norwalk, CT (US)

( * ) Notice: Subject to any disclaimer, the term of this patent is extended or adjusted under 35 U.S.C. 154(b) by 475 days.

(21) Appl. No.: 11/012,481

(22) Filed: Dec. 16, 2004

(65) Prior Publication Data

US 2006/0134380 A1 Jun. 22, 2006

(51) Int. Cl.
*G03G 15/16* (2006.01)

(52) U.S. Cl. ..... 399/297; 430/125.3; 428/195.1; 428/211.1; 428/212; 428/532; 428/537.5

(58) Field of Classification Search ..... 399/297; 430/125.3; 428/195.1, 211.1, 212, 532, 537.5
See application file for complete search history.

(56) References Cited

U.S. PATENT DOCUMENTS 7,128,978 B2 * 10/2006 Sisler et al. ..... 428/532

* cited by examiner

*Primary Examiner*—Bruce H. Hess
*Assistant Examiner*—David J. Joy
(74) *Attorney, Agent, or Firm*—Oliff & Berridge, PLC

(57) ABSTRACT

An enhanced or optimized cast-coated paper for enhancing or improving toner adhesion, and a method for forming an image on the enhanced or optimized cast-coated paper, includes a paper sheet with a coating solution on at least one surface of the paper sheet, the cast-coated paper having at least: a thermal diffusivity of less than approximately 9.0 $mm^2/s$ and total surface free energy component of less than 38 $erg/cm^2$. Printing the cast-coated paper in an electrophotographic apparatus includes forming an image with an electrophotographic toner in the electrophotographic apparatus and transferring the image to the cast-coated paper having the thermal diffusivity of less than approximately 9.0 $mm^2/s$ and the total surface free energy component of less than 38 $erg/cm^2$. The cast-coated paper may be used in apparatuses utilizing an electrophotographic process, such as a copying machine, a printer, a facsimile machine, a color-copying machine, and the like.

17 Claims, 4 Drawing Sheets

CAST-COATED PAPERS HAVING ENHANCED IMAGE PERMANENCE WHEN USED WITH COLOR XEROGRAPHIC PRINTING AND A METHOD OF PRINTING THE CAST-COATED PAPERS IN AN ELECTROPHOTOGRAPHIC APPARATUS

BACKGROUND

The exemplary embodiments relate to an enhanced or optimized cast-coated paper for enhancing or improving toner adhesion, and a method for forming an image on the enhanced or optimized cast-coated paper. The cast-coated paper may be used in apparatuses utilizing an electrophotographic process, such as a copying machine, printer, facsimile and the like.

In an electrophotographic process, a fixed image is formed through a plurality of processes in which a latent image is electrically formed on a photosensitive material utilizing a photoconductive substance. This latent image is developed using a toner, and the toner latent image on the photosensitive material is transferred onto a transfer material, such as paper, to manifest a toner image. Then, this transferred image is fixed onto the paper. Electrophotographic processes are used in copying machines, printers and the like.

In forming an image, cast-coated paper may be utilized. Cast-coated paper is generally obtained by applying a coating solution containing a pigment and a binder to at least one side of a substrate, i.e., raw paper. The cast-coated paper has features including high gloss and smoothness. Accordingly, cast-coated paper allows for high quality printing.

Cast-coated paper represents a high or the highest quality paper printing media in terms of substrate gloss. There are significant differences in image permanence (toner adhesion) between different commercially available cast-coated papers. Toner adhesion across these papers varies from excellent to extremely poor.

SUMMARY

A relationship between coated paper, toner and fusing with respect to the quality of the papers for toner adhesion is not understood in the related art. In the absence of such an understanding, each cast-coated paper is typically evaluated on each color xerographic machine to ascertain its image permanence.

Different types of cast-coated papers having different characteristics may be used to enhance or optimize the final print or copy, depending upon the type of imager being used. For example, caliper (thickness), grammage (area density), apparent density and surface roughness are properties of paper that may be varied depending on the proposed use of the paper. The various combinations of these and other properties, as well as other features including, for example, drying time, are considered when choosing an enhanced or optimum paper for a specific imaging device, such as a printer or copier.

More specifically, cast-coated printing papers are characterized by numerous physical and optical attributes. To specify a paper having properties that meet all the requirements of a particular printing process as suitable, paper properties which contribute to performance and print quality must first be identified, and a desirable range of values for each of the paper properties must be specified for each selected property.

Determining a desirable range of values for each of the paper properties is typically performed by a trial and error process, sometimes taking over decades to develop. These papers have been developed in this manner for each successive development of printing technology. Examples of these papers include specific papers engineered for sheet-fed offset, web offset, gravure, flexo, ink jet, thermal transfer and xerographic printing processes. This successive trial and error process has resulted in each cast-coated paper having its own unique properties resulting in a range of image qualities. However, none of the paper properties of commercially available cast-coated papers have been identified and then enhanced or optimized to increase toner adhesion and to thereby enhance or improve image permanence.

A related art printing technology includes Digital Color Production Printing (DCPP) using xerography. This refers to 4 or more color xerographic printing at process speeds exceeding 60 pages/minute. DCPP printers are used for commercial print applications, where they typically replace short to medium run offset presses.

The principal substrate used for DCPP, as well as commercial printing, is coated paper. While the related art includes a clear understanding of coated paper specifications for sheet and web offset printing, there has not been a specification developed for coated papers for xerographic DCPP.

The exemplary embodiments address these and other issues by providing a paper specification developed for cast-coated papers for xerographic DCPP. The exemplary embodiments define a set of properties for enhanced or optimal toner adhesion to cast-coated papers in xerographic DCPP.

Experiments were conducted on approximately 18 commercial cast-coated papers to assess the xerographic DCPP toner adhesion for each paper. The experiments included identifying thermal transfer, surface thermodynamic and physical properties related to density and surface roughness for each paper; controlled xerographic imaging of each paper with iGen3 toner; fusing of images on each paper at different temperature levels using an iGen3fuser (B1 fixture); and measurement of image permanence. The resulting model identifies the properties of cast-coated papers critical to achieving image permanence; also establishing optimum levels and key interactions for each variable. The model accounts for 70% of the observed variability in image permanence for 18 cast-coated papers studied.

Thermal diffusivity and dispersive surface free energy of the paper were identified as critical properties in determining toner adhesion (i.e., image permanence). As a result, paper specifications for cast-coated papers for enhanced or optimal toner adhesion using xerographic DCPP include 8-10 $mm^2/s$ for thermal diffusivity (measured at 100° C.) and 28-42 $erg/cm^2$ for total surface free energy of the paper.

Although, the related art includes commercial papers that may meet some of these specific properties, there are no known commercial papers that meet both of the noted critical properties within the range identified above.

Exemplary embodiments identify specific critical properties for enhanced or improved toner adhesion and image permanence, and enhance or optimize the identified specific critical properties. More specifically, the enhanced or optimum cast-coated paper for xerographic DCPP preferably includes a paper specification having at least a thermal diffusivity (measured at 100° C.) less than approximately 9.0 $mm^2/s$ and a total surface free energy component less than 38 $erg/cm^2$.

DETAILED DESCRIPTION OF EMBODIMENTS

Figure 1:
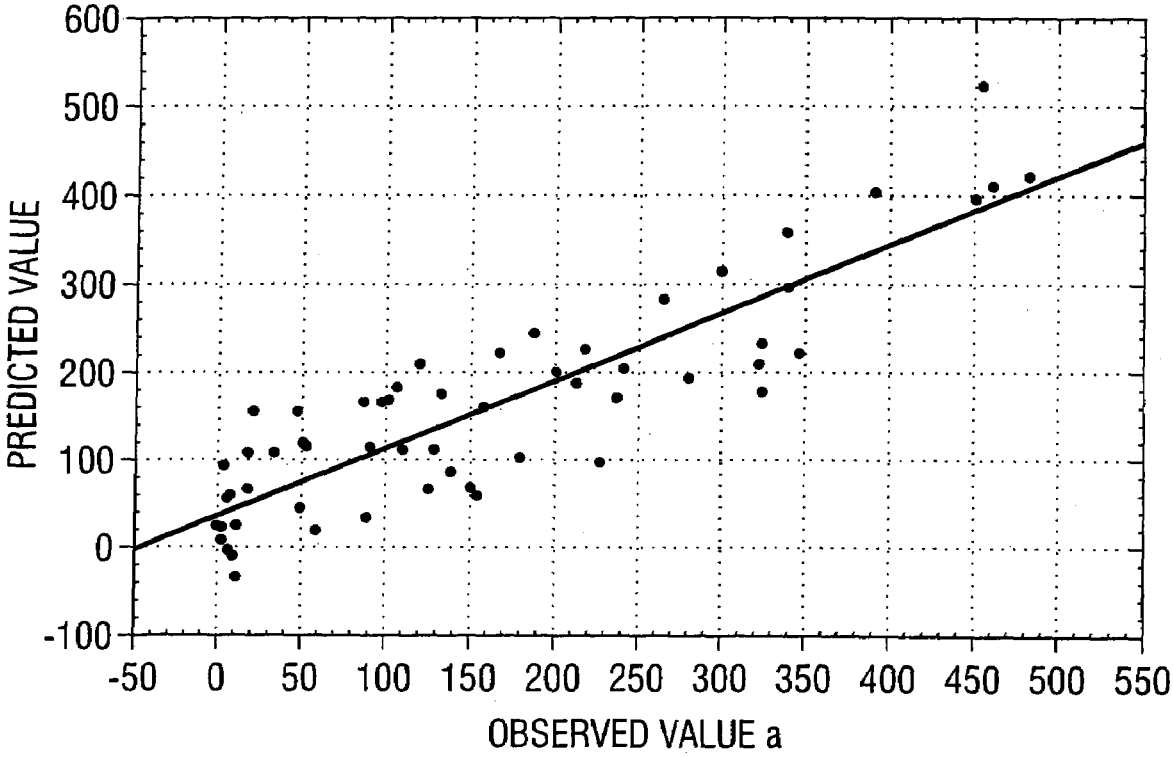
FIG. 1 is a chart of an observed versus predicted scatter plot in a central composite response surface model based on cast-coated paper properties of 18 paper samples in an exemplary embodiment.

A digital electrophotographic method can be used in printing and copying machines to provide both high speed and high image quality. In this method, a light beam, which is adjusted to a predetermined spot diameter in an image optical system, is used for scanning of a photosensitive member. A latent image in an area modulation mode, which corresponds to an image density signal, is formed on the photosensitive member. The area modulation is modulated by an ON/OFF time duration of the light beam corresponding to the image density signal determined by a pulse duration modulation means. A toner visualizes the latent image, and image forming is thus completed.

A process for forming an image in which a toner image is formed is not limited to electrophotography. For example, the process may be a process in which a toner flies directly onto a toner image carrier according to an image data already receiving digital processing, and thereafter a toner image is formed on the toner image carrier.

The image forming process may also be a process in which a magnetic latent image is formed on a toner image carrier according to an image data already receiving digital processing, and the toner image is formed according to the magnetic image on the toner image carrier.

The image forming process may also be a process in which an electrostatic latent image is formed by writing a charge image directly on a toner image carrier according to an image data already receiving digital processing. The toner image is thereafter formed on the toner image carrier according to the electrostatic latent image. The toner images thus formed on the toner image carrier are temporarily transferred on an intermediate transfer member, and subsequently the toner image is further transferred on a recording medium for simultaneous transfer and/or fixing.

The imaging forming process can employ an initial step of charging a photoconductive member to a substantially uniform potential, and thereafter exposing the photoconductive member to record the latent image. A print engine in the image forming system can have at least four developer stations. Each developer station has a corresponding developer structure. Each developer structure can contain one of magenta, yellow, cyan or black toner. The print engine may include additional developer stations having developer structures containing other types of toner, such as MICR (magnetic ink character recognition) toner, for example. The print engine may also include one, two or three developer structures having one, two or three different types of toner, respectively. An exposure process can precede each of the developer stations. Further, each of the developer stations can include a corresponding dispenser for supplying toner particles to the developer structure. Each developer station can apply a different type of toner to the latent image.

In an exemplary embodiment, cast-coated papers are used. Cast-coated papers include a substrate coated with a solution containing pigment and a binder. In the cast-coating process pigmented coating applied to a paper substrate is dried against a highly polished heated chrome cylinder thereby replicating the smoothness and gloss of the metal surface on the coated paper surface. This process eliminates the need for paper calendaring thereby maintaining bulk, and at the same time achieves the highest gloss levels for coated paper.

In order to identify the significant or critical properties, which increase toner adhesion to enhance or improve image permanence, approximately 18 commercial cast-coated papers (hereinafter referred to as "sample papers"), were collected and their properties measured to determine each of the sample papers specific attributes. In general, most of the properties of the sample papers were measured using known Technical Association of Pulp and Paper Industry (TAPPI) methods, such as TAPPI 405.

For example, the sample papers may include "Xerox Supergloss" manufactured by Zanders, "Kromecote Laser High Gloss" manufactured by Smart Papers, "Kromecote Plus" manufactured by Smart Papers, and "Mead Mark V" manufactured by Mead.

Extensive experiments were conducted to assess the xerographic DCPP toner adhesion for each sample paper. In particular, the thermal properties, the surface thermodynamic properties, the surface roughness, the grammage, the caliper and the apparent density of each sample paper were measured. A table is provided below which summarizes a minimum value, a maximum value, and a mean value of different properties of the sample papers that were measured.

CAST-COATED PAPERS - RANGE OF PHYSICAL PROPERTIES

| Physical Property | Units | Mean | Minimum | Maximum |
|---|---|---|---|---|
| grammage | $g/m^2$ | 221.12 | 199.85 | 251.65 |
| caliper | microns | 260.34 | 230.00 | 309.80 |
| apparent density | $g./cm^3$ | 0.85 | 0.81 | 0.88 |
| Parker Print Surf | microns | 0.66 | 0.44 | 0.92 |
| Gardiner Gloss 75o | GGU | 83.87 | 78.33 | 90.68 |
| Dynamic Roughness | 10 $kg/cm^2$ - microns | 0.27 | 0.09 | 0.61 |
| | 15 $kg/cm^2$ - microns | 0.21 | 0.07 | 0.49 |
| | 20 $kg/cm^2$ - microns | 0.17 | 0.06 | 0.39 |
| water contact angle | 0.1 s | 90.42 | 80.40 | 103.00 |
| | 1.0 s | 88.93 | 74.45 | 101.45 |
| | 10 s | 87.12 | 70.10 | 99.50 |
| water contact angle slope | | −1.65 | −9.25 | 0.00 |
| formamide contact angle | 0.1 s | 74.89 | 66.30 | 85.05 |
| | 1.0 s | 74.09 | 66.20 | 82.45 |
| | 10 s | 72.07 | 62.80 | 81.80 |
| formamide contact angle slope | | −1.41 | −8.90 | 0.15 |
| diiodomethane contact angle | 0.1 s | 55.60 | 45.35 | 62.70 |
| | 1.0 s | 55.04 | 44.85 | 62.75 |
| | 10 s | 52.66 | 42.70 | 60.30 |
| diiodomethane contact angle slope | | −1.47 | −3.18 | −0.90 |

-continued

CAST-COATED PAPERS - RANGE OF PHYSICAL PROPERTIES

| Physical Property | Units | Mean | Minimum | Maximum |
|---|---|---|---|---|
| dispersive component surface free energy | erg/cm$^2$ | 31.08 | 27.02 | 36.82 |
| base component surface free energy | erg/cm$^2$ | 5.68 | 0.56 | 13.17 |
| acid component surface free energy | erg/cm$^2$ | 0.23 | 0.00 | 2.05 |
| total surface free energy | erg/cm$^2$ | 32.91 | 28.08 | 41.87 |
| reversible heat capacity (25° C.) | J/g/° C. | 1.20 | 1.10 | 1.36 |
| reversible heat capacity (50° C.) | J/g/° C. | 1.30 | 1.19 | 1.48 |
| reversible heat capacity (75° C.) | J/g/° C. | 1.39 | 1.26 | 1.58 |
| reversible heat capacity (100° C.) | J/g/° C. | 1.44 | 1.29 | 1.64 |
| thermal diffusivity (25° C.) | mm$^2$/s | 0.09 | 0.08 | 0.12 |
| thermal diffusivity (50° C.) | mm$^2$/s | 0.10 | 0.08 | 0.12 |
| thermal diffusivity (100° C.) | mm$^2$/s | 0.09 | 0.08 | 0.12 |
| thermal conductivity (50° C.) | W/m° K | 0.11 | 0.08 | 0.13 |
| thermal conductivity (100° C.) | W/m° K | 0.12 | 0.10 | 0.14 |

Thermal properties including heat capacity, thermal conductivity, and thermal diffusivity were each measured at 25° C., 50° C. and 100° C. using differential scanning calorimetry (DSC) and laser flash diffusivity.

In order to measure the surface thermodynamic properties, the contact-angle for three solvents over a range of 0.1-10 seconds were measured, and the dispersive and polar surface free energy components were calculated. In one exemplary embodiment, the dispersive and polar surface free energy components were calculated using the Wu geometric mean method, which is a technique for determining surface energy.

The surface roughness was measured using the Parker Print-Surf (PPS) method. However, other surface roughness methods could also be used, such as, for example, the Gardner gloss method, the Toyo-Seiki Topography dynamic roughness method, and the like.

Each sample paper was imaged using a control black toner in a control carrier of a digital color printer (test fixture). Toner mass per unit area (TMA) was controlled to 0.5+/−0.5 mg/cm$^2$ for each sample paper by making frequent gravimetric TMA measurements. The images were then fused on the test fixture at a speed of 92 ft/min and at fusing temperatures of 345° F., 365° F. and 385° F. Toner adhesion was measured for each sample paper using a Taber model 5700 Linear Abraser (i.e., a scratch test). In particular, the preferred scratch test was developed through experimentation by controlling the load weight, the load rate, tip hardness and tip sharpness.

The sample papers with better than average toner adhesion were identified using the scratch test and their respective paper properties analyzed. Analysis of these results led to a cast-coated paper with optimum toner adhesion.

Figure 2:
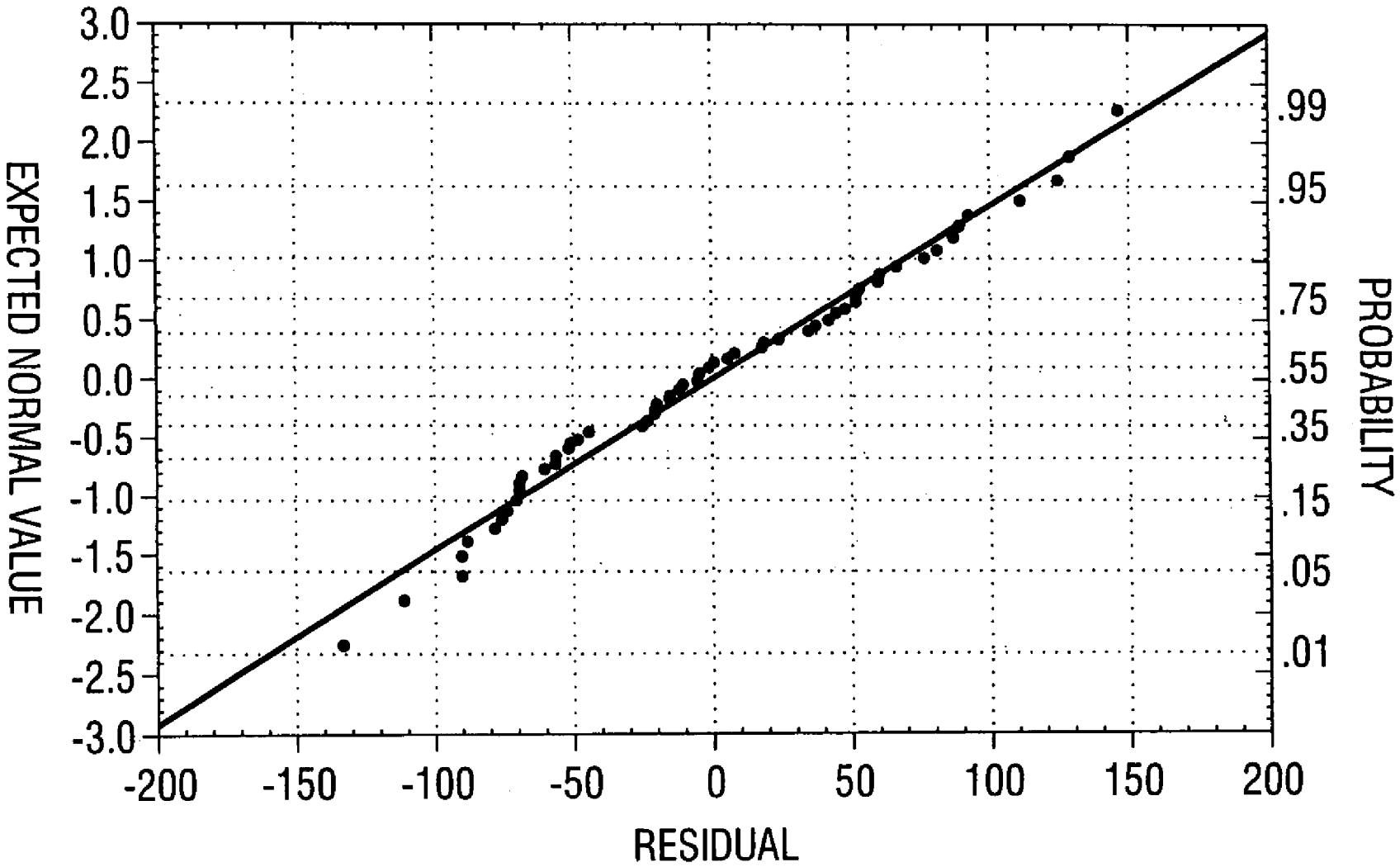
FIG. 2 is a chart of a normal probability plot of residuals in a central composite response surface model based on cast-coated paper properties of 18 paper samples in an exemplary embodiment.

More specifically, based on the Taber model, central composite response surface models were used to fit various sets of fusing and cast-coated paper properties to a response variable of toner adhesion, (i.e., crease area). Overall, the better models, relative to both statistical and physical significance, employed the following factors: fusing temperature, grammage, surface free energy (Dispersive (LW) component), and thermal diffusivity. The correlation coefficient ($r^2$) (observed/predicted) for this model is about 70% and the residuals were reasonable normally distributed as shown in the charts for FIGS. 1 and 2.

These models enabled for the identification of thermal diffusivity and dispersive surface free energy as critical properties of cast-coated papers with respect to determining toner adhesion and illustrated how to enhance or optimize both these properties to enhance or improve toner adhesion.

Figure 3:
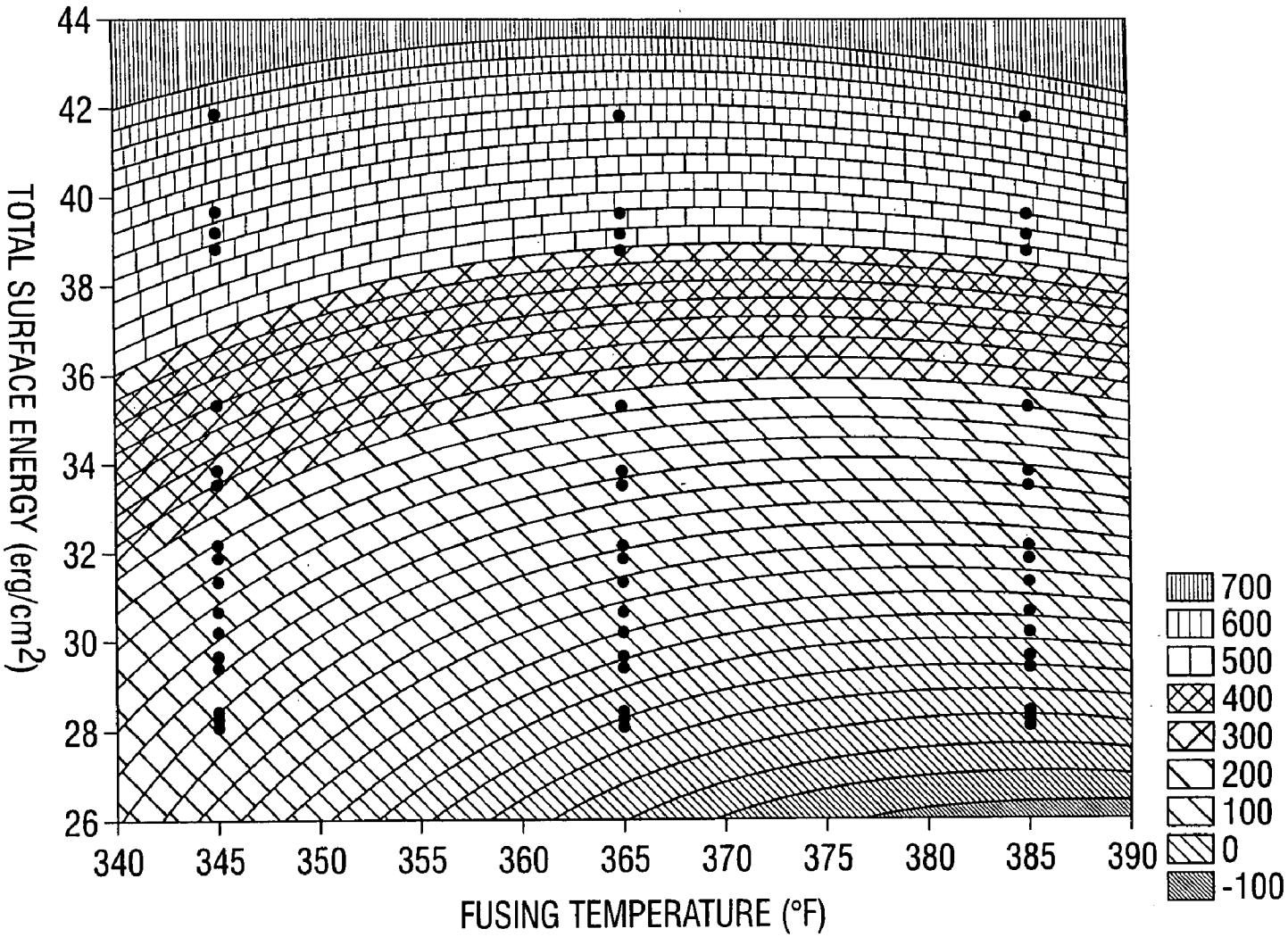
FIG. 3 is a total surface energy v. fusing temperature in a central composite response surface model based on cast-coated paper properties of 18 paper samples in an exemplary embodiment.
Figure 4:
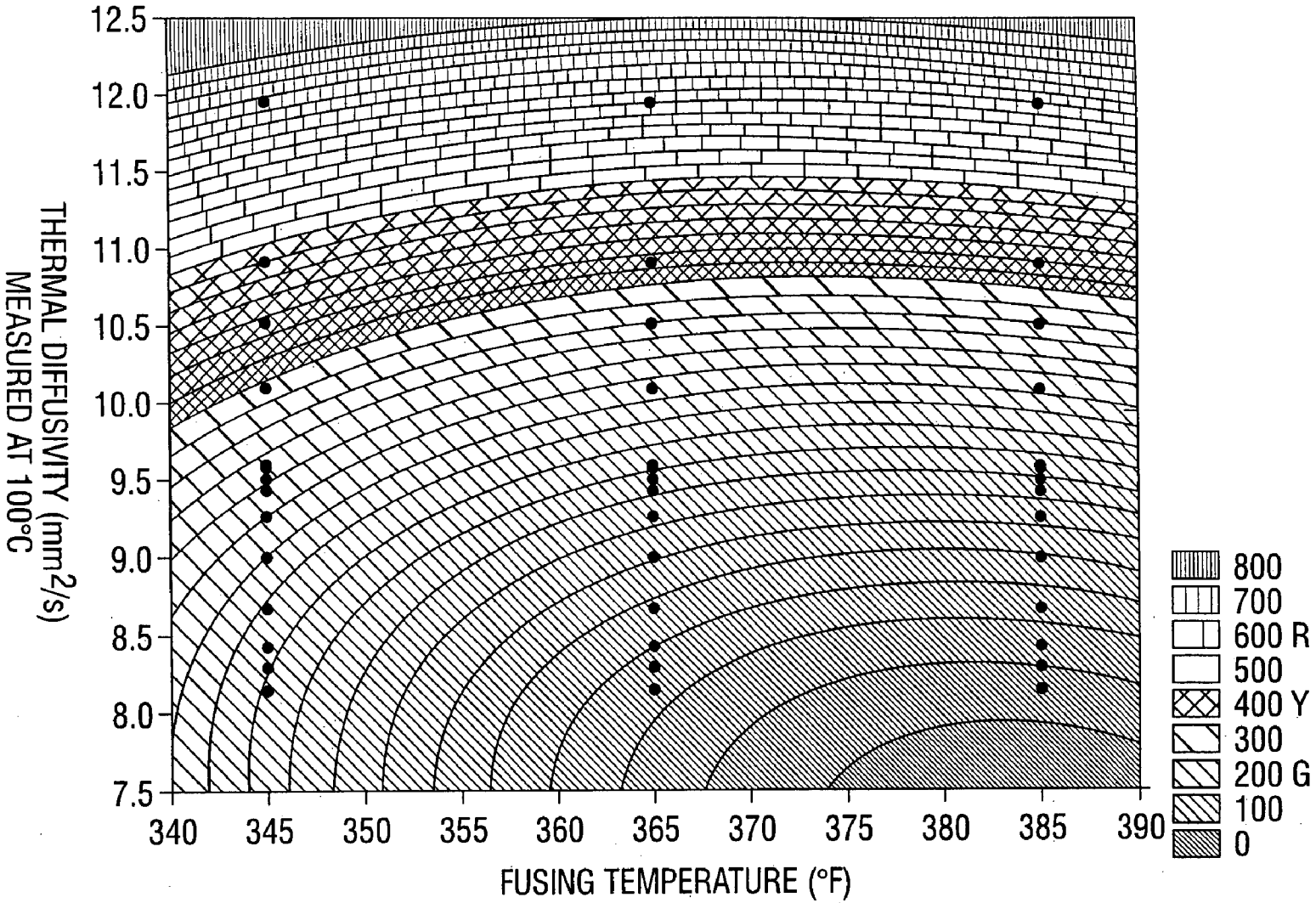
FIG. 4 is a chart of thermal diffusivity measured at 100° C. versus fusing temperature in a central composite response surface model based on cast-coated paper properties of 18 paper samples in an exemplary embodiment.

Further, as illustrated in FIGS. 3 and 4, response surface plots from the above identified model indicate that for a given fusing temperature, lower dispersive surface energy and lower thermal diffusivity enhance or improve toner adhesion on cast-coated papers.

Based on the above described models, the paper specifications for cast-coated papers to meet the requirement for enhanced or optimal toner adhesion, particularly with respect to the formation of images using xerographic DCPP, include the critical properties of thermal diffusivity and dispersive surface free energy. In one exemplary embodiment, the cast-coated papers that meet the requirement for enhanced or optimal toner adhesion may also include critical properties associated with, for example, grammage, caliper, apparent density and surface roughness.

More specifically, in an exemplary embodiment, cast-coated paper that meets the requirement for enhanced or optimal toner adhesion may include the following properties: Grammage of 200-275 gsm; Caliper of 220-320 microns; Apparent Density of 0.75-1.0 g/cm$^3$; Gloss (75°) of 75-95 GGU; and Parker Print-Surf of 0.25-1.2 microns (soft packing, 1.0 MPa).

In an exemplary embodiment, thermal diffusivity and total surface free energy having the critical properties of less than 9.0 mm$^2$/s and less than 38 erg/cm$^2$ respectively, provide cast-coated paper with enhanced or optimal toner adhesion. These specific property parameters of these two critical properties further enhance or optimize toner adhesion on the cast-coated paper. None of the commercially available sample papers include the combination of these two critical properties. The combination of these two properties provides superior toner adhesion as measured using a scratch indenter testing device. This property is important for many image permanence considerations, including abrasion resistance, scuff resistance, scratch resistance, and the like.

While embodiments have been described in conjunction with the specific exemplary embodiments described above, it is evident that many alternatives, modifications and variations will be apparent to those skilled in the art. Accordingly, the exemplary embodiments, as set forth above, are intended to be illustrative and not limiting. Various changes may be made without departing from the spirit and scope of the exemplary embodiments.

What is claimed is:

1. A cast-coated paper, comprising:

a paper sheet defining at least one surface; and a coating solution on the at least one surface of the paper sheet so as to provide a thermal diffusivity of less than approximately 9.0 mm$^2$/s, and a total surface free energy component less than 38 erg/cm$^2$.

2. The cast-coated paper according to claim 1, wherein the cast-coated paper further has a grammage in the range of 200-275 gsm.

3. The cast-coated paper according to claim 1, wherein the cast-coated paper further has a caliper in the range of about 220-320 microns.

4. The cast-coated paper according to claim 1, wherein the cast-coated paper further has an apparent density of about 0.75-1.0 g/cm$^3$.

5. The cast-coated paper according to claim 1, wherein the cast-coated paper further has a surface roughness in the range of 0.25-1.2 microns.

6. The cast-coated paper according to claim 1, wherein the cast-coated paper further has a gloss in the range of 75-95 GGU.

7. A method of printing cast-coated paper in an electrophotographic apparatus, comprising:

forming an image with an electrophotographic toner with the electrophotographic apparatus; and transferring the image to a cast-coated paper, the cast-coated paper comprising:

a paper sheet defining at least one surface; and a coating solution on the at least one surface of the paper sheet so as to provide a thermal diffusivity of less than approximately 9.0 mm$^2$/s, and a total surface free energy component of less than 38 erg/cm$^2$.

8. The method according to claim 7, wherein the cast-coated paper further has a grammage in the range of about 200-275 gsm.

9. The method according to claim 7, wherein the cast-coated paper further has a caliper in the range of about as above 220-320 microns.

10. The method according to claim 7, wherein the cast-coated paper further has a gloss in the range of 75-95 GGU.

11. The method according to claim 7, wherein the cast-coated paper further has a surface roughness in the range of 0.25-1.2 microns.

12. The method according to claim 7, wherein the electrophotographic apparatus is a copying device.

13. The method according to claim 7, wherein the electrophotographic apparatus is a facsimile device.

14. The method according to claim 7, wherein the electrophotographic apparatus is a printer.

15. The method according to claim 14, wherein the printer is a digital color production printer.

16. The method according to claim 7, wherein the step of forming the image with the electrophotographic toner specific for at least one of the electrophotographic apparatus and the cast-coated paper.

17. The method according to claim 7, wherein the step of forming the image with the electrophotographic toner that is not specific to at least one of the electrophotographic apparatus and the cast-coated paper.

* * * * *